United States Patent [19]

Kaporovich et al.

[11] 4,061,009

[45] Dec. 6, 1977

[54] MACHINE FOR SPINNING TUBULAR WORKPIECES

[76] Inventors: Vladimir Georgievich Kaporovich, ulitsa Lenina, 2, kv. 106; Viktor Grigorievich Sereda, ulitsa Jubileinaya, 11, kv. 127; Vitaly Kirillovich Udovenko, ulitsa Parkovaya, 35, kv. 105; Nadezhda Nikolaevna Zelenskaya, ulitsa Shkadinova, 58, kv. 75; Viktor Yakovlevich Brazhnik, ulitsa Pionerskaya, 5, kv. 34, all of Kramatorsk; Evgeny Pavlovich Sviridov, ulitsa Orlovskaya, 6, kv. 80; Jury Nikolaevich Fabrichev, ulitsa Volodarskogo, 54, kv. 44, both of Bryansk, all of U.S.S.R.

[21] Appl. No.: 740,736

[22] Filed: Nov. 10, 1976

[51] Int. Cl.[2] ..... B21D 41/04

[52] U.S. Cl. ..... 72/69; 72/71; 72/121

[58] Field of Search ..... 82/61, 67, 72; 228/60; 219/154; 72/69, 71, 121

[56] References Cited

U.S. PATENT DOCUMENTS

| | | | |
|---|---|---|---|
| 2,219,279 | 10/1940 | Gaspar | 219/154 |
| 2,341,144 | 2/1944 | Hill | 72/69 |
| 2,373,472 | 4/1945 | Haumiller | 82/72 |
| 3,851,515 | 12/1974 | Hautau | 72/121 |

*Primary Examiner*—Lowell A. Larson
*Attorney, Agent, or Firm*—Fleit & Jacobson

[57] ABSTRACT

A machine for spinning tubular workpieces comprises a bed which mounts a spindle with a forming tool adapted for spinning a heated tubular workpiece and associated with a drive. There is provided a device for clamping the tubular workpiece, stationary mounted on the bed and arranged ahead of and coaxially with the spindle on the side thereof along which the tubular workpiece is fed thereinto, and a mechanism for feeding the tubular workpiece into the spindle, rigidly affixed on the bed ahead of the clamping device for gripping the tubular workpiece. The spindle of the machine for spinning tubular workpieces is made as a combination of a main sleeve and an auxiliary one with the bore axis of said main sleeve being somewhat offset with respect to the longitudinal axis of said main sleeve, whereas the auxiliary sleeve is turnably mounted within the aforesaid main sleeve and coaxially with its bore, the rotation speed of the auxiliary sleeve being slightly different from that of the main sleeve. Therewith, the forming tool is rigidly fixed in the auxiliary sleeve.

8 Claims, 6 Drawing Figures

MACHINE FOR SPINNING TUBULAR WORKPIECES

BACKGROUND OF THE INVENTION

The present invention relates to metal, working, and more particularly to machines for spinning of tubular workpieces.

The proposed invention may be suitably used in the production of hollow axisymmetric articles from tubular workpieces, for example, in the production of cylinders from pipes of undefined length, which are cut off concurrently with spinning of the bottom and neck portions thereof. This invention is also suited for obtaining various reductions at the end portions of pipes or elsewhere along the length thereof, as well as for reducing the end portions in articles constructed from pipes, such as high-pressure cylindrical vessels, deep-bottom cylinders, along with hollow hermetically sealed ends of spheres and semi-spheres, articles having a recurring profile, and complex-shaped bottoms.

Known in the prior art are machines for spinning of tubular workpieces, wherein a workpiece and a tool have parallel axes of rotation, comprising a bed with a spindle rotatably mounted thereupon and fitted with a device for clamping the workpiece, said spindle being made as a chuck. The workpiece is arranged in the spindle so that its end, the length of which is equal to that of the spinning zone, extends outside. Mounted on the bed ahead of the spindle is a feeding carriage having a cross feed with respect to the axis of rotation of the spindle with the workpiece. Fixed on the feeding carriage is a forming tool with a drive adapted to turn the tool. The tool is made as a roller having a configuration such that its successive sections make for smooth transitions from the initial shape of the workpiece generatrix to a desired shape thereof. The axis of the tool is parallel to the rotation axis of the spindle.

A pre-heated tubular workpiece is first fed into the rotating spindle, then centered and clamped in the chuck. Thereafter the forming tool rotation drive is actuated and the spinning process is carried on by way of continuous sliding friction of the workpiece against the forming tool.

The disadvantage of the aforesaid machine lies in the fact that it is capable of carrying out spinning only of the end portion of a tubular workpiece, and also that said workpiece is necessarily subjected to rotation in a machine, which is undesirable in the case of long-length tubes.

There is also known a machine with a tangentially fed forming tool, adapted for hot spinning of spherical bearings and flat bottoms of telescopic hydraulic jacks used in tipping trucks.

The above machine comprises the following units: a bed; a spindle mounted on said bed in bearing assemblies; a spindle drive mounted within said bed; a feeding carriage arranged on the bed ahead of the spindle and provided with a hydraulic drive accommodated within said bed.

The spindle is fitted at its end with a jaw chuck collet which is tightened by means of a V-ring. Arranged within the spindle is a positive stop with a feed spring.

The upper part of the feeding carriage mounts a table moving in transverse direction with respect to the spindle. Affixed on the table is a forming tool.

A pre-heated workpiece is fed into the spindle as far as it can go, causing the spring to contract. The workpiece is clamped in the chuck collet which is set in rotation. The hydraulic cylinder is then actuated to provide for the cross feed of the forming tool having such a configuration that its generatrices allow, in the course of spinning, for successive transitions from the initial shape of the workpiece to a desired shape thereof. With the spinning process being over, the chuck collet is opened, the compressed spring is released and the workpiece is pushed out of the spindle.

The disadvantage of said machine lies in the fact that it allows spinning only of the end portions of tubular workpieces. The spindle interior limits the length of a workpiece to be worked, while imperative rotation of the workpiece in the spindle is undesirable in case of long-length tubes.

There is also known a machine for the spinning of tubular workpieces, in which the working process is realized by means of a tangentially moving forming friction tool, with the furnished tapered portion of the workpiece being cut off.

The aforesaid machine comprises a bed which mounts a driven hollow spindle fitted with a chuck for clamping a workpiece. Mounted on the bed ahead of the spindle is a cross slide on which are affixed a forming tool and a cutter adapted for cutting off the worked piece. The cross slide is driven by means of a motor through a program drum tracer which allows for the slide to travel forward at a greater speed during spinning operation and at a lower speed during cutting-off operation, with subsequent retreating of the slide to its initial position. The drive mechanism of said slide is mounted on the machine bed.

A pre-heated workpiece is thrust into the spindle to be clamped in the jaw chuck. The spindle is then set into rotation by means of the motor through a belt drive. In the course of the interaction between the rotating workpiece and the transversely moving forming tool, the heated end of the workpiece is caused to deform.

The spinning operation being over, the chuck jaws are unclamped and the workpiece is released from the spindle.

The disadvantage of the aforesaid machine resides in that spinning can be carried out only at the end portion of the workpiece, and also in that the workpiece has to be rotated which is undesirable in case of long tubes.

There is known still another machine for the spinning of tubular workpieces, comprising a bed on which a spindle is mounted in bearing assemblies wherein the spindle is provided with external and internal shafts. Said shafts are set into rotation by means of a motor through a belt drive and two gear drives having different speeds of rotation due to the difference in the value of the gear train thereof. The motor is located on the machine bed. Fitted on the spindle external shaft is a spindle nose with a faceplate, and arranged in said spindle nose are axles with a forming roller and an anvil roller mounted thereon. Fitted on the free ends of said roller axles are gear wheels internally toothed with gear cages mounted on axles which, in turn, are arranged on auxiliary axles arranged within the spindle nose. The gear cages are externally toothed with the gear wheel fitted on an internal shaft. The workpiece together with the clamping device is rigidly fixed foward of the spindle with the faceplate whereby the roll-forming of the workpiece free end is made possible.

To start the operation, the motor is energized to impart rotation to the spindle through the belt drive and gear drives. The forming tool is rotated about the axis of the workpiece. Due to a slight speed difference in rotation of the internal and external shafts, the rotation is imparted through the gear pair to the axle on which is mounted the tool.

The production potentialities of the hereinbefore described machine are limited in that it does not provide for the spinning of a tubular workpiece other than at the end portions thereof. It is likewise impossible to obtain several profiles in the workpiece at one time.

SUMMARY OF THE INVENTION

It is, therefore, an object of the present invention to obviate the above disadvantages inherent in the prior-art machines for spinning tubular workpieces.

It is also an object of the present invention to enable spinning of tubular workpieces at the portions away from the ends thereof.

It is another object of the invention to make possible the fabrication of articles from long tubes by way of spinning thereof.

It is still another object of the invention to provide for the simultaneous spinning of various profiles of articles.

It is yet another object of the invention to combine several operating cycles of the spinning process with heating of the tube.

The herein proposed invention also aims to provide a machine of small bulk.

Accordingly, it is the primary object of the present invention to provide a machine for the spinning of tubular workpieces, fitted with a spindle which will enable the spinning of various portions in a tubular workpiece both at the ends thereof or elsewhere therebetween, said workpiece being kept stationary.

These and other objects are attained in a machine for the spinning of tubular workpieces, comprising a bed on which is securely mounted a spindle with a forming tool for spinning a heated tubular workpiece and connected with a drive; a device for clamping the tubular workpiece, stationarily mounted on the bed ahead of and coaxially with the spindle on the side thereof along which the tubular workpiece is fed thereinto; a mechanism for feeding the tubular workpiece into the spindle, rigidly affixed on the bed ahead of the workpiece clamping device on the side thereof along which the tubular workpiece is fed. The spindle is made as a combination of a main sleeve, the bore axis of which being somewhat offset with respect to the longitudinal axis of the sleeve, and an auxiliary sleeve turnably mounted within said main sleeve and coaxially with its bore, whereas the forming tool is rigidly fixed in the auxiliary sleeve whose rotation speed differs somewhat from that of the main sleeve.

It is preferable that the machine for the spinning of tubular workpieces has its main and auxiliary sleeves in toothed connection with the spindle drive by means of gear trains with gear rings thereof being fitted on each sleeve. Gear wheels mesh with said gear rings, and are mounted on a common drive shaft connected with the spindle drive.

It is expedient that the machine for the spinning of tubular workpieces be provided with a heating device mounted on the machine bed within such a distance from the spinning zone which would correspond to the length of the article to be obtained.

It is advantageous that the machine for spinning tubular workpieces have its clamping device made as insulated jaws to which is connected a heating device, namely a power transformer.

The fact that the spindle is made as a sleeve enables it to carry out the spinning of a tubular workpiece within the portions away from the ends thereof.

The spinning of the stationary workpiece is possible due to the fact that the machine auxiliary sleeve is mounted within and eccentric to the main sleeve whose bore axis is somewhat offset with respect to the longitudinal axis thereof and coincides with the longitudinal axis of the auxiliary sleeve with the forming tool being rigidly fixed therein.

The main and auxiliary sleeves are in toothed connection with a drive by means of gear trains whose rotation speeds slightly differ from each other, which makes possible the spinning of the workpiece surface along its diameter.

The clamping device is mounted on the machine bed within a distance from the forming tool, which enables the heating and spinning of a tubular workpiece to be carried out at one time in different zones with subsequent feeding of the heated section into the working zone with no time for its cooling.

The fact that the clamping device is made as insulated jaws having connected thereto a heating device in the form of a power transformer, permits combining the heating device with the clamping device.

The present invention will now be further described in terms of a specific embodiment thereof, taken in conjunction with the accompanying drawings.

DETAILED DESCRIPTION OF THE DRAWINGS

Figure 1:
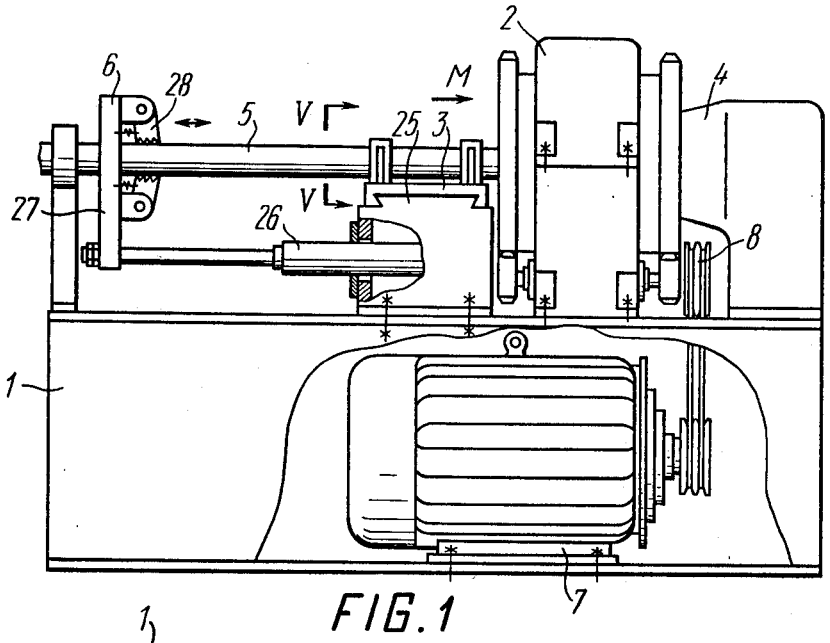
FIG. 1 is a general view of a machine for the spinning of tubular workpieces.

The machine, according to the invention, comprises a bed 1 mounting a spindle 2. Mounted on the bed 1 are clamping devices 3 and 4 for gripping a workpiece 5, the workpiece 5 being kept stationary. Mounted also on the bed 1 and ahead of the clamping device 3 is a mechanism 6 for feeding the tubular workpiece 5. Arranged within the bed 1 is a motor 7 which imparts rotation through a belt drive 8 to the spindle 2.

Figure 3:
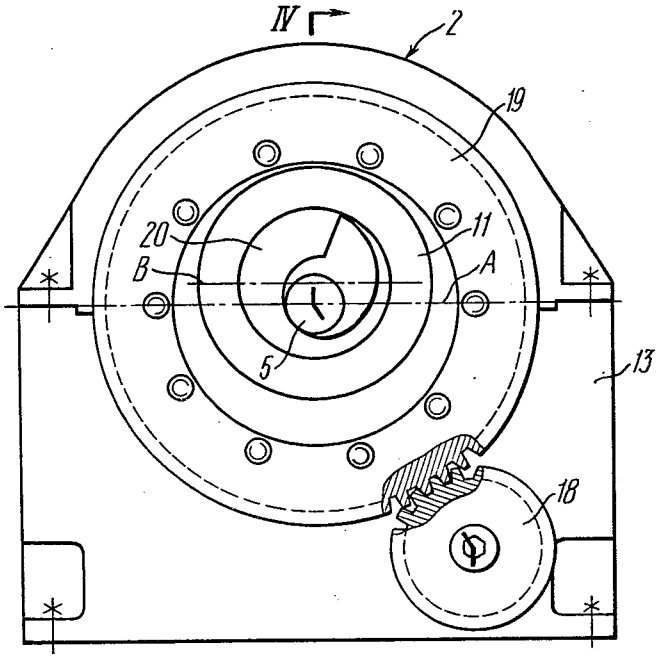
FIG. 3 is a view of a spindle taken along arrow M of FIG. 1.
Figure 4:
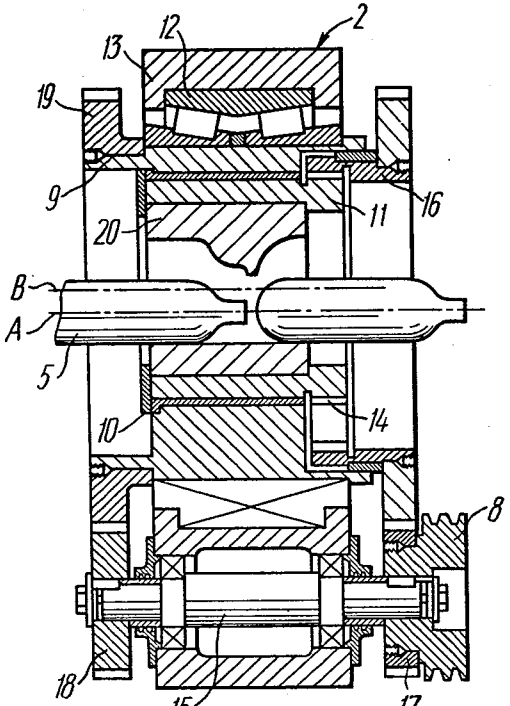
FIG. 4 is a sectional view of a spindle taken along line IV—IV of FIG. 3.

The spindle 2, as shown in FIGS. 3 and 4 is made as a combination of a main sleeve 9, the bore axis B of which is somewhat offset with respect to the longitudinal axis A of said sleeve 9. Fitted into the bore of the main sleeve 9 by means of a sliding bearing 10 and coaxially with said bore is an auxiliary sleeve 11. The axis of the auxiliary sleeve 11 is somewhat offset with respect to the longitudinal axis A of the main sleeve 9.

The main sleeve 9 rests upon a bearing 12 having its exterior-ring fixed in the barrel 13 of the spindle 2. The auxiliary sleeve 11 is fitted with a gear ring 14 engaged with a drive shaft 15, mounted within the barrel 13 of the spindle 2, through a gear cluster 16 and a pinion 17.

Fitted on the drive shaft 15 is a pinion 18 which is brought in mesh with a gear ring 19 affixed on the main sleeve 9. The pinions 17 and 18 have equal number of teeth, whereas the gear ring 19 and the tooth-wheel rim of the gear cluster 16 differ in the number of teeth. This is done for the purpose of attaining a difference in the rotation speed of the main sleeve 9 and that of the auxiliary sleeve 11, which is a specific feature of the spinning process applied when the tubular workpiece 5 being worked remains stationary.

A forming tool 20 is rigidly fixed on the auxiliary sleeve 11.

The difference between the rotation speed of the main sleeve 9 and that of the auxiliary sleeve 11, as well as their eccentric arrangement, enables the carrying out of the spinning of the stationary workpiece 5.

In one particular embodiment of the invention the rotating speed of the main sleeve is 312 rpm and that of the auxiliary sleeve, 300 rpm. The resultant speed of the tool rotation about the workpiece axis was equal to 3 rpm.

The fact that the spindle 2 is constructed in the form of sleeves, makes it possible to carry out the spinning of long tubular workpieces both at the ends thereof and within portions away from the ends.

Figure 2:
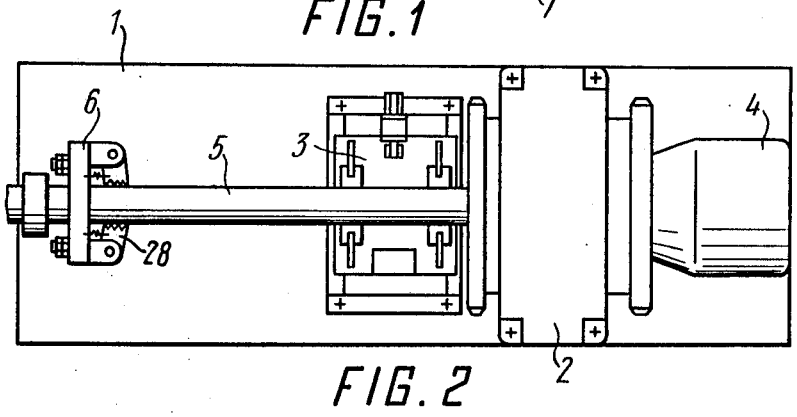
FIG. 2 is a plan view of a machine for the spinning of tubular workpieces.
Figure 5:
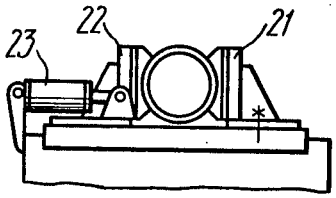
FIG. 5 shows a section V—V of FIG. 1.
Figure 6:
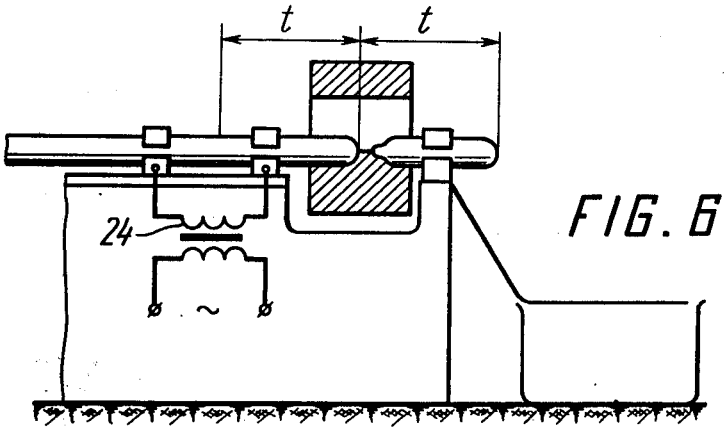
FIG. 6 shows a heating device.

The clamping device 3 in FIGS. 1 and 2 is made in the form of two pairs of gripping jaws, these being stationary jaws 21 as shown in FIG. 5 and adjustable jaws 22 which are actuated by an air cylinder 23. The gripping jaws 21, 22 are made insulated, the stationary jaws 21 being energized with the aid of bus bars from a power transformer 24 (FIG. 6).

The fact that the clamping device 3 is constructed in the form of jaws which have connected thereto a heating device in the form of the power transformer 24 (FIG. 6), allows the clamping device to be combined with the heating device.

The heating device, combined with the clamping device 3 is arranged on the bed 1 at a distance from the spinning zone, said distance corresponding to the length of the article to be obtained. This permits spinning and heating of two sections of a tubular workpiece at a time. Furthermore, with the heating device being disposed in proximity with the spinning zone, the heated portion of the tubular workpiece does not cool off before it is passed to the spinning zone.

The clamping device 3 is arranged on a support means 25, as shown in FIG. 1, mounted on the bed 1, which accomodates an air cylinder 26 of the drive of the feeding mechanism 6.

The feeding mechanism 6 incorporates a faceplate 27 with a bore to pass the workpiece 5 therethrough. Positioned on the faceplate 27 around the tubular workpiece 5 are spring-actuated dogs 28 for gripping the tubular workpiece 5 to be fed to the spinning zone.

The hereinbefore described machine functions as follows.

The air cylinder 26 is actuated to urge the feeding mechanism 6 towards the spindle 2. As this happens, the spring-actuated dogs 28 grip the tubular workpiece 5, moving it to the heating zone. Next the air cylinder 23 (FIG. 5) is actuated. The adjustable jaws 22 clamp the workpiece 5 in the clamping device 3. When the stationary jaws 21 are energized, the portion of the workpiece 5 found in the clamping device 3 is heated. At this time the rod of the air cylinder 26 is returned to its initial position thereby pulling back the feeding mechanism 6. The air cylinder 23 releases the workpiece 5 and then the cylinder 26 is actuated to feed the heated portion of the workpiece 5 into the spindle 2. The air cylinder 26 functions to clamp the tubular workpiece 5. The next portion of the tubular workpiece 5 is heated in the clamping device 3. Simultaneously with the heating the spinning of the already heated portion of the tubular workpiece 5 is carried out. The motor 7 is switched on, whereby rotation is imparted to the drive shaft 15 through the belt drive 8. The rotation is transmitted from the drive shaft 15 by means of the pinion 17 and the gear cluster 16 to the auxiliary sleeve 11 with the forming tool 20 being secured thereto, and through the pinion 18 and the gear ring 19 to the main sleeve 9. The spinning process is carried out by virtue of compound motion translated to the tool 20 which is caused to rotate about the axis of the stationary workpiece 5 simultaneously with rotation about its own axis.

Such a compound motion is made possible due to the fact that the bore axis B of the main sleeve 9 is somewhat offset with respect to the longitudinal axis A of the main sleeve 9, and arranged around said bore is the auxiliary sleeve 11 coaxially with the longitudinal bore axis B of the main sleeve 9. The tool 20 is securely fixed within the auxiliary sleeve 11. The rotation of the tool 20 about its own longitudinal axis, which coincides with the axis of the auxiliary sleeve 11, is effected with the aid of the pinions 17–16, whereas the rotation of the tool 20 about the workpiece axis is effected by means of the pinions 18–19.

Moreover, in order to carry out the spinning of the stationary workpiece along its entire diameter it is necessary to provide a slight difference between the rotation speed of the tool 20 about its own axis and about the axis of the workpiece 5. This is achieved by having the number of teeth in the pinions 18 and 17 be made equal, while the teeth of the gear ring 19 and of the toothwheel rim of the gear cluster 16 are made different.

The profile of the tool 20 is made such that its generatrix corresponds to the gradual transition from the workpiece generatrix to a desired shape thereof.

It is due to both the design of the spindle 2 as a combination of two sleeves, and compound motion of the forming tool 20 having a specific profile that the spinning of the workpiece 5 is possible to carry out at the portion away form the ends thereof.

After the spinning process is over, the motor 7 is switched off, the air cylinder 23 FIG. 5 operates to unclamp the jaws 22 thus releasing the workpiece 5. The next heated portion of the tubular workpiece 5 is then fed into the spinning zone with the aid of the air cylinder 26 and the process starts all over again.

What is claimed is:

1. A machine for the spinning of tubular workpieces, comprising: a bed; a spindle mounted on said bed, said spindle comprising a main sleeve and an auxiliary sleeve, the bore axis of said main sleeve being somewhat offset with respect to the longitudinal axis of said main sleeve, said auxiliary sleeve being turnably mounted within said main sleeve and coaxially with the bore of said main sleeve, means for rotating said auxiliary sleeve and said main sleeve wherein said auxiliary sleeve is rotated at a speed slightly different from that of the main sleeve; a forming tool means for spinning a heated tubular workpiece, said forming tool means rigidly fixed within said auxiliary sleeve; clamping device means for clamping the tubular workpiece, means for stationary mounting of said clamping device means on said bed ahead of and coaxially with said spindle on the side of said spindle which receives the tubular workpiece; a feeding means for feeding the tubular workpiece into said spindle, said feeding means rigidly affixed on said bed ahead of said clamping device means.

2. A machine for the spinning of tubular workpieces as claimed in claim 1, wherein said means for rotating said main and auxiliary sleeves comprise a spindle drive motor, gear means comprising gear rings fitted on each sleeve, and pinions in mesh with said gear rings, wherein said pinions are arranged on a common drive shaft connected with said spindle drive motor.

3. A machine for the spinning of tubular workpieces as claimed in claim 1, further comprising a heating device means stationarily mounted on said bed within a distance from the spinning zone corresponding to the length of the article to be obtained.

4. A machine for the spinning of tubular workpieces as claimed in claim 3, wherein said heating device means comprises a power transformer.

5. A machine for the spinning of tubular workpieces as claimed in claim 4, wherein said clamping device means comprises insulated jaws, said power transformer connected with said insulated jaws.

6. A machine for the spinning of tubular workpieces as claimed in claim 2, further comprising a heating device means stationarily mounted on said bed within a distance from the spinning zone corresponding to the length of the article to be obtained.

7. A machine for the spinning of tubular workpieces as claimed in claim 6, wherein said heating device means comprises a power transformer.

8. A machine for the spinning of tubular workpieces as claimed in claim 7, wherein said clamping device means comprises insulated jaws, said power transformer connected with said insulated jaws.

* * * * *